US011635002B2

(12) United States Patent
Terada et al.

(10) Patent No.: US 11,635,002 B2
(45) Date of Patent: Apr. 25, 2023

(54) STEAM TURBINE, CENTER GUIDE PIN, AND METHOD FOR MANUFACTURING STEAM TURBINE

(71) Applicant: MITSUBISHI HEAVY INDUSTRIES COMPRESSOR CORPORATION, Tokyo (JP)

(72) Inventors: Katsumi Terada, Hiroshima (JP); Hiroaki Irikawa, Hiroshima (JP); Yuichi Sasaki, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 334 days.

(21) Appl. No.: 16/479,641

(22) PCT Filed: Feb. 24, 2017

(86) PCT No.: PCT/JP2017/007210
§ 371 (c)(1),
(2) Date: Jul. 22, 2019

(87) PCT Pub. No.: WO2018/154734
PCT Pub. Date: Aug. 30, 2018

(65) Prior Publication Data

US 2021/0332722 A1 Oct. 28, 2021

(51) Int. Cl.
*F01D 25/28* (2006.01)
*F01D 5/02* (2006.01)
*F01D 25/24* (2006.01)

(52) U.S. Cl.
CPC ..... *F01D 25/28* (2013.01); *F01D 5/02* (2013.01); *F01D 25/24* (2013.01); *F05D 2260/30* (2013.01)

(58) Field of Classification Search
CPC ... F01D 25/28; F05D 2260/30; F05D 2260/36
See application file for complete search history.

(56) References Cited

U.S. PATENT DOCUMENTS

2015/0078892 A1* 3/2015 Lomas ..... B25B 27/16 415/214.1

FOREIGN PATENT DOCUMENTS

JP H02-087905 U 7/1990
JP H10-077803 A 3/1998
(Continued)

OTHER PUBLICATIONS

International Search Report and Written Opinion in corresponding International Application No. PCT/JP2017/007210, dated Apr. 25, 2017 (15 pages).

*Primary Examiner* — Courtney D Heinle
*Assistant Examiner* — John S Hunter, Jr.
(74) *Attorney, Agent, or Firm* — Osha Bergman Watanabe & Burton LLP

(57) ABSTRACT

A steam turbine includes a rotor, a casing, a partition plate, and a center guide pin. The center guide pin has a positioning portion. In a state of being attached to a pin attachment portion formed in one of the casing and the partition plate, the positioning portion is disposed in a groove portion formed in the other of the casing and the partition plate. The positioning portion includes a plurality of abutment portions capable of abutting on an inner side surface of the groove portion, around a pin axis. The plurality of abutment portions is formed to have different horizontal distances from the pin axis.

6 Claims, 8 Drawing Sheets

(56) References Cited

FOREIGN PATENT DOCUMENTS

| | | | |
|---|---|---|---|
| JP | 2004-162536 | A | 6/2004 |
| JP | 2010-121498 | A | 6/2010 |
| JP | 2014-066174 | A | 4/2014 |

* cited by examiner

STEAM TURBINE, CENTER GUIDE PIN, AND METHOD FOR MANUFACTURING STEAM TURBINE

TECHNICAL FIELD

The present invention relates to a steam turbine, a center guide pin, and a method for manufacturing a steam turbine.

BACKGROUND ART

From the viewpoint of ease of assembly or the like of a steam turbine, in some cases, a cylindrical casing and an annular partition plate may be divided into a plurality of parts in a circumferential direction.

Patent Literature 1 discloses a steam turbine in which a partition plate and a casing are divided into upper and lower halves. In the steam turbine described in Patent Literature 1, a structure that performs positioning of the partition plate in a horizontal direction perpendicular to an axis with respect to the casing using a guide pin provided in each of the divided upper half portion and lower half portion is provided. In this structure, groove portions extending in an axial direction of a rotor are formed in each of an uppermost part of the upper half partition plate and a lowermost part of the partition plate of the lower half portion, and guide pin attaching holes are formed on an inner side surface of the casing facing the groove portions. When the guide pins are inserted and fixed into the guide pin attaching holes, part of the guide pins protrudes toward the partition plate, and the protruding portion is accommodated in the groove portion. When such a protruding portion is accommodated in the groove portion, the guide pin enters a state in which the displacement of the groove portion in a width direction is regulated, while displacement in an extending direction of the groove portion is enabled. That is, when using the guide pin described in Patent Literature 1, it is possible to regulate displacement of the partition plate with respect to the casing in the horizontal direction intersecting the axis, while enabling the displacement of the partition plate with respect to the casing in the axial direction.

CITATION LIST

Patent Literature

[Patent Literature 1]
Japanese Utility Model Publication No. H2-87905

SUMMARY OF INVENTION

Technical Problem

At the time of processing such as cutting, an error occurs in the size of the groove portion or the dimension of the attaching hole formed in the partition plate described in Patent Literature 1. Therefore, it is necessary to absorb the positional deviation caused by such a dimensional error with the guide pin. However, when preparing guide pins of a plurality of types corresponding to dimensional errors to adjust the position, there is a problem in that in the number of components is increased.

Further, when the guide pin is processed (overlay welding, cutting or the like) to be adjusted, there is a problem in that the burden on the assembling worker is increased.

The present invention provides a steam turbine, a center guide pin, and a method for manufacturing a steam turbine, capable of reducing the number of components and reducing the burden on an assembling worker.

Solution to Problem

According to a first aspect of the present invention, a steam turbine includes a rotor, a casing, a partition plate, and a center guide pin. The rotor is rotatable around an axis. The casing extends in a circumferential direction of the rotor and is vertically divided in a horizontal plane. The partition plate is disposed between the casing and the rotor, extends in the circumferential direction of the rotor and is vertically divided in the horizontal plane. The center guide pin performs positioning of the partition plate with respect to the casing in the horizontal direction perpendicular to the axis from above and below the horizontal plane. One of an outer surface of the partition plate and an inner surface of the casing facing the outer surface of the partition plate includes groove portions. The groove portions are disposed at each of a vertically upward position and a vertically downward position on the axis and extends in the axial direction. The other of the outer surface of the partition plate and the inner surface of the casing facing the outer surface of the partition plate includes pin attachment portions. The pin attachment portions are disposed at each of the vertically upward position and the vertically downward position on the axis. The pin attachment portions are capable of fixing the center guide pin by selecting a rotation angle around a pin axis extending in the vertical direction. The center guide pin includes a positioning portion disposed inside the groove portion in a state in which it is attached to the pin attachment portion. The positioning portion includes a plurality of abutment portions capable of abutting against an inner side surface of the groove portion, around the pin axis. The plurality of abutment portions are formed so that distances in the horizontal direction from the pin axis are different from each other.

With this configuration, by changing the rotation angle of the center guide pin attached to the pin attachment portion around the pin axis, it is possible to change the abutment portion caused to abut on the inner side surface of the groove portion. Since each of the plurality of abutment portions formed in the positioning portion have different horizontal distances from the pin axis, the distance in the horizontal direction from the pin axis to the inner side surface of the groove portion is changed. That is, it is possible to adjust the position of the partition plate in the horizontal direction perpendicular to the axis with respect to the casing, depending on the rotation angle of the center guide pin, without changing the type of the center guide pin.

Accordingly, the number of components can be reduced and the burden on the assembling worker can be reduced.

According to a second aspect of the present invention, the positioning portion according to the first aspect may be formed so that an outline of a cross section perpendicular to the pin axis is formed in a tubular shape having a regular polygon, and a central axis of the regular polygon may be disposed to be offset with respect to the pin axis in the horizontal direction.

With such a configuration, a corner portion and a side portion of the regular polygon can be used as the abutment portion of the positioning portion. Therefore, it is possible to easily form a plurality of abutment portions having different horizontal distances from the pin axis.

According to a third aspect of the present invention, the positioning portion according to the first aspect may be formed so that an outline of a cross section perpendicular to the pin axis is formed in a tubular shape of a circle, and a central axis of the circle may be offset with respect to the pin axis in a horizontal direction.

With such a configuration, a circular outer peripheral portion can be used as the abutment portion of the positioning portion. Therefore, it is possible to easily form a plurality of abutment portions having different distances in the horizontal direction from the pin axis. In addition, since the circular outer peripheral portion is used as the abutment portion, the distance in the horizontal direction from the pin axis can be changed steplessly. Therefore, it is possible to more finely adjust the position of the partition plate with respect to the casing in the horizontal direction perpendicular to the axis.

According to a fourth aspect of the present invention, the center guide pin according to any one of the first to third aspects may include a pin base portion in which the outline of the cross section perpendicular to the pin axis is formed in a circular shape centered on the pin axis, and may include a penetration hole through which a fastening member having a male screw portion is capable of penetrating around the pin axis. The pin attachment portion may include a concave portion which accommodates the pin base portion to be rotatable about the pin axis, and a female screw portion which is formed on an extension line of the pin axis and capable of accepting the male screw portion of the fastening member.

With this configuration, it is possible to easily rotate the pin base portion around the pin axis within the concave portion of the pin attachment portion. Therefore, the rotation angle of the center guide pin can be easily changed. Further, by causing the fastening member to penetrate through the penetration hole and screwing the male screw portion of the fastening member into the female screw portion, the center guide pin having a desired rotational angle can be easily fixed to the pin attachment portion.

According to a fifth aspect of the present invention, the center guide pin is a center guide pin which performs positioning of a partition plate with respect to a casing of a steam turbine in a horizontal direction perpendicular to a rotor shaft. The center guide pin includes a positioning portion and a pin base portion. The positioning portion can be accommodated in a groove portion provided in one of an inner surface of the casing and an outer surface of the partition plate. The pin base portion can be attached to a pin attachment portion provided on the other of the inner surface of the casing and the outer surface of the partition plate. The pin base portion can be fixed to the pin attachment portion by selecting a rotation angle about a pin axis. The positioning portion includes a plurality of abutment portions capable of abutting an inner side surface of the groove portion. The plurality of abutment portions are formed so that distances from the pin axis in the horizontal direction are different from each other.

With such a configuration, by changing the rotation angle of the center guide pin attached to the pin attachment portion around the pin axis, it is possible to change the abutment portion caused to abut the inner side surface of the groove portion. Since each of the plurality of abutment portions formed in the positioning portion has a different horizontal distance from the pin axis, the distance in the horizontal direction from the pin axis to the inner side surface of the groove portion is changed. That is, it is possible to adjust the position of the partition plate with respect to the casing in the horizontal direction perpendicular to the axis, depending on the rotation angle of the center guide pin, without changing the type of the center guide pin.

According to a sixth aspect of the present invention, the positioning portion according to the fifth aspect may be formed so that an outline of a cross section perpendicular to the pin axis has a tubular shape of a regular polygon, and a central axis of the regular polygon may be offset with respect to the pin axis in the horizontal direction.

With such a configuration, a corner portion and a side portion of the regular polygon can be used as the abutment portion of the positioning portion. Therefore, it is possible to easily form a plurality of abutment portions having different distance in the horizontal direction from the pin axis.

According to a seventh aspect of the present invention, the positioning portion according to the fifth aspect may be formed so that the outline of the cross section perpendicular to the pin axis has a tubular shape of a circle, and a central axis of the circle may be offset with respect to the pin axis in the horizontal direction.

With such a configuration, a circular outer peripheral portion can be used as the abutment portion of the positioning portion. Therefore, it is possible to easily form a plurality of abutment portions having different distances in the horizontal direction from the pin axis. In addition, since the circular outer peripheral portion is used as the abutment portion, the distance in the horizontal direction from the pin axis can be changed steplessly. Therefore, it is possible to more finely adjust the position of the partition plate with respect to the casing in the horizontal direction perpendicular to the axis.

According to an eighth aspect of the present invention, the pin base portion according to any one of the fifth to seventh aspects may be formed so that the outline of the cross section perpendicular to the pin axis has a circular shape centered on the pin axis, and the pin base portion may include a penetration hole through which a fastening member having a male screw portion is capable of penetrating, around the pin axis.

With this configuration, it is possible to rotate the pin base portion around the pin axis in a state of causing the fastening member to penetrate through the penetration hole. Therefore, it is possible to easily change the rotation angle of the center guide pin.

According to a ninth aspect of the present invention, a method for manufacturing a steam turbine is a method for manufacturing a steam turbine including a rotor, a casing, a partition plate, and a center guide pin. The rotor is rotatable around an axis. The casing extends in a circumferential direction of the rotor and is vertically divided by a horizontal plane. The partition plate is disposed between the casing and the rotor, extends in the circumferential direction of the rotor and is vertically divided by the horizontal plane. The center guide pin performs positioning of the partition plate with respect to the casing in a horizontal direction perpendicular to the axis from above and below the horizontal plane. Further, the plurality of center guide pins are capable of changing a relative position of the partition plate with respect to the casing in the horizontal direction, by changing a rotation angle around a pin axis extending in a vertical direction. The method for manufacturing the steam turbine includes a temporary assembling process, a measuring process, a determining process, and an adjusting process. The temporary assembling process accommodates upper and lower two half partition plates constituting the partition plate in each of upper and lower two half casings constituting the casing, and temporarily assembles the upper and lower two half partition plates in a state of positioning the half partition plate with respect to the half casing in a horizontal direction perpendicular to the axis using the center guide pin. The measuring process measures sizes of gaps between the half casing and the half partition plate temporarily assembled by the temporary assembling process on the horizontal plane, respectively. The determining process determines whether the sizes of each gap measured in the measuring process are within a target range. The adjusting process changes a rotation angle of the center guide pin about the pin axis of the center guide pin in a direction in which the sizes of the gaps are within the target range to adjust the sizes of the gaps, and assembles the half partition plate to the half casing, when the sizes of the gaps are determined not to be within the target range by the determining process.

By temporarily assembling the half casing and the half partition plate in this manner, the sizes of the gaps between the half casing and the half partition plate are measured on the horizontal plane, and in the case where the sizes of the gaps are not within the target range, it is possible to determine that the relative position of the half partition plate with respect to the half casing in the horizontal direction perpendicular to the axis is misaligned. At this time, for example, only by extracting the half partition plate from the half casing, rotating the center guide pin around the pin axis, and returning the half partition plate back into the half casing again, the size of the gap between the half casing and the half partition plate can be adjusted. That is, it is possible to adjust the position of the partition plate with respect to the casing in the horizontal direction perpendicular to the axis without replacing the center guide pin.

Advantageous Effects of Invention

According to the steam turbine, the center guide pin and the method for manufacturing the steam turbine, it is possible to reduce the number of components and to reduce the burden on the assembling worker.

DESCRIPTION OF EMBODIMENTS

First Embodiment

Next, a steam turbine, a center guide pin, and a method for manufacturing a steam turbine according to a first embodiment of the present invention will be described with reference to the drawings.

Figure 1:
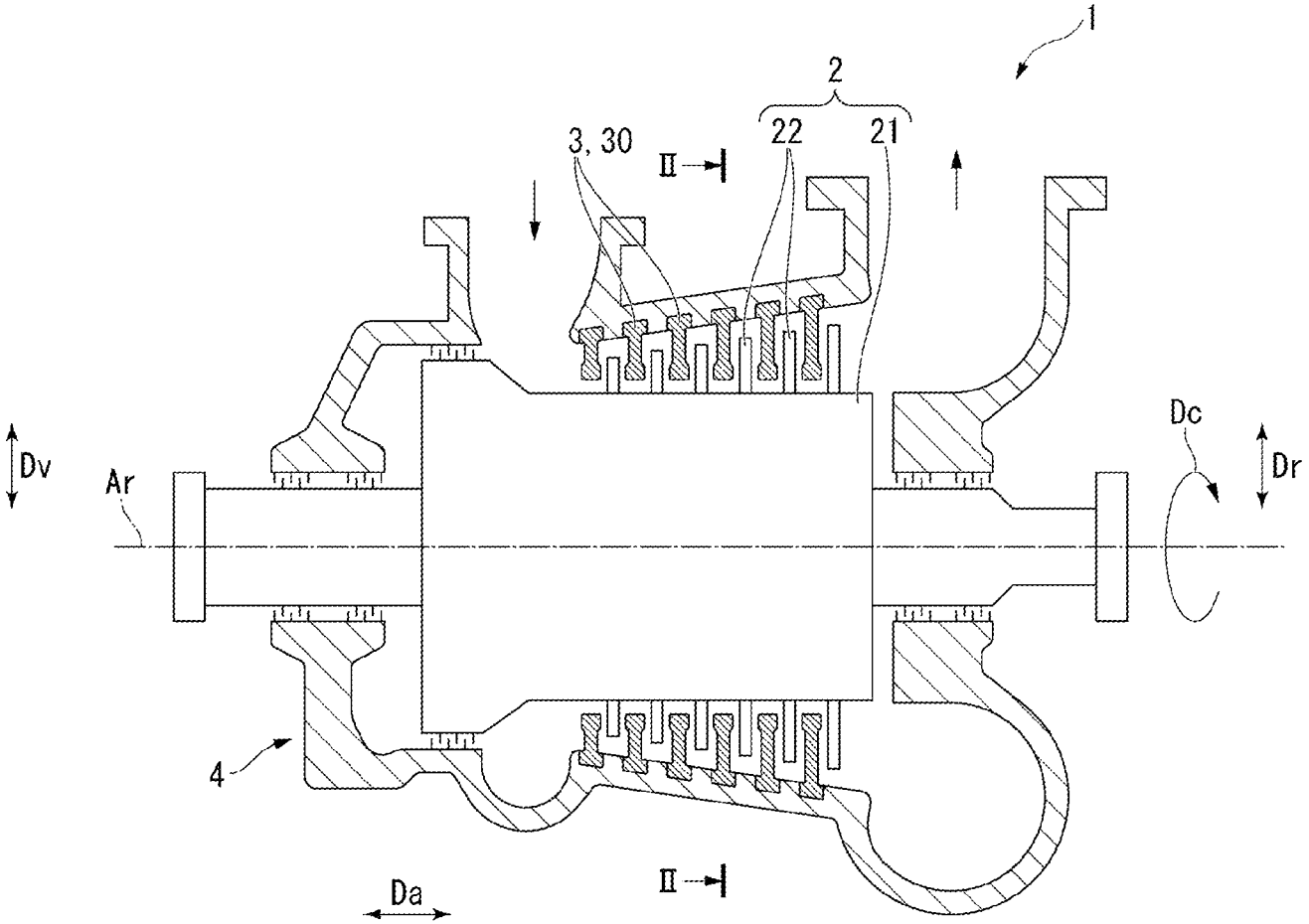
FIG. 1 is a configuration diagram illustrating a schematic configuration of a steam turbine according to a first embodiment of the present invention.
Figure 2:
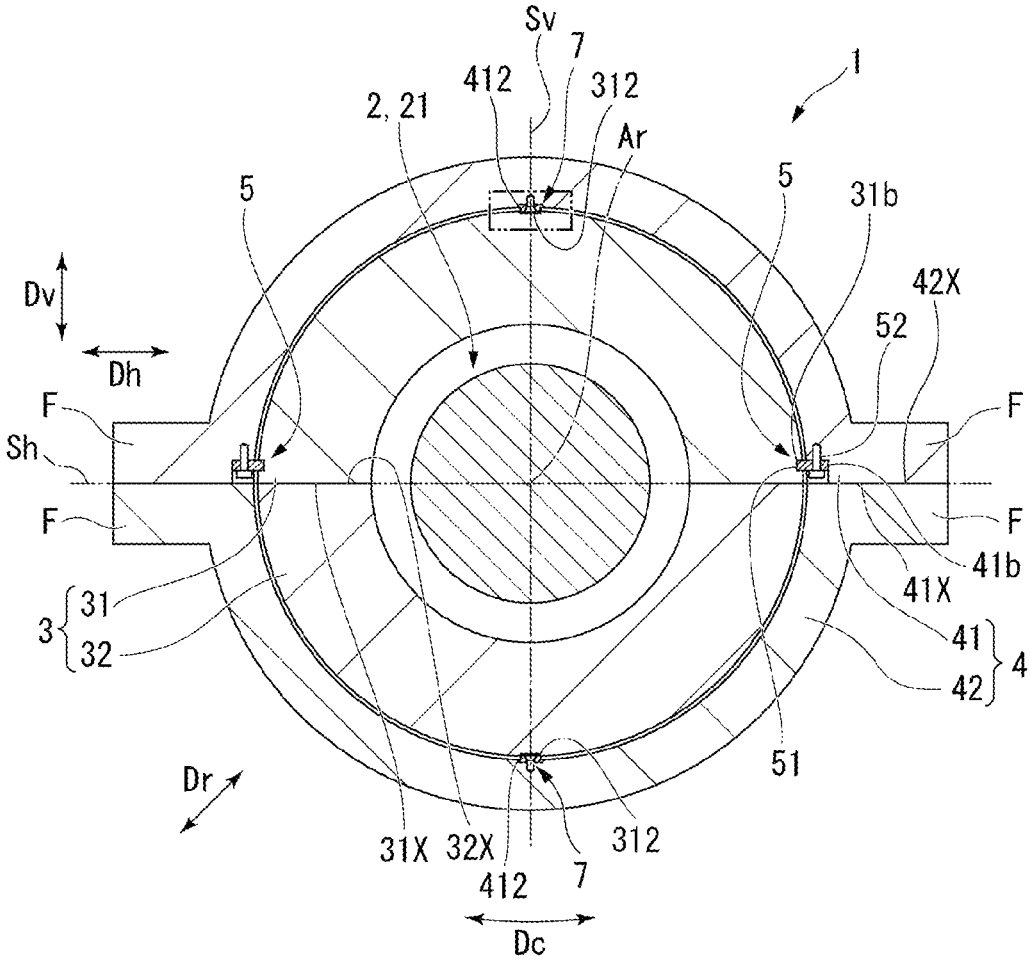
FIG. 2 is a cross-sectional view taken along line II-II of FIG. 1.

FIG. 1 is a configuration diagram illustrating a schematic configuration of a steam turbine according to the first embodiment of the present invention. FIG. 2 is a cross-sectional view taken along line II-II of FIG. 1.

As illustrated in FIGS. 1 and 2, the steam turbine 1 includes a rotor 2, a casing 4, a partition plate 3, a vertical position defining portion 5, and a center guide pin 7.

The rotor 2 is rotatable about an axis Ar. The rotor 2 includes a rotor shaft 21 and a plurality of rotor vanes 22. The rotor shaft 21 extends in an axial direction Da around the axis Ar. The plurality of rotor vanes 22 are fixed to the rotor shaft 21. The rotor vanes 22 are disposed side by side in a circumferential direction Dc around the axis Ar.

In the following description, a direction in which the axis Ar extends is defined as the axial direction Da.

A radial direction Dr around the axis Ar is simply defined as a radial direction Dr.

A vertical direction of the paper surface of FIG. 2 in the radial direction Dr perpendicular to the axis Ar is defined as a vertical direction Dv.

A left-right direction of FIG. 2 is defined as a horizontal direction Dh.

A direction around the rotor 2 centered on the axis Ar is defined as a circumferential direction Dc.

The casing 4 is formed to cover the rotor 2 from the outside. More specifically, the casing 4 is formed in a tubular shape extending in the circumferential direction Dc of the rotor 2. The casing 4 is vertically divided by a horizontal plane Sh including the axis Ar. In other words, the casing 4 includes an upper half casing (a half casing) 41 disposed above the axis Ar of the rotor 2, and a lower half casing (a half casing) 42 disposed below the axis Ar of the rotor 2.

The upper half casing 41 includes a division surface 41X which is a plane spreading in the horizontal direction, at an end portion in the circumferential direction Dc. Similarly, the lower half casing 42 has a division surface 42X which is a plane spreading in the horizontal direction, at the end portion in the circumferential direction Dc. The upper half casing 41 and the lower half casing 42 each have a flange portion F that protrudes to extend the division surfaces 41X and 42X to the outside in the horizontal direction Dh. A flange portion F of the upper half casing 41 and a flange portion F of the lower half casing 42 are fixed by fastening members such as bolts and nuts in a state in which the division surfaces 41X and 42X of the upper half casing 41 and the lower half casing 42 are caused to abut each other.

The partition plate 3 is disposed between the casing 4 and the rotor 2. The partition plate 3 is formed to extend in the circumferential direction Dc. The partition plate 3 is formed annularly around the axis Ar that covers the rotor 2 from outside in the radial direction Dr. The partition plate 3 includes a plurality of stator vanes (nozzles) 30 (not illustrated in FIG. 2) which rectify the steam to be supplied toward the rotor vanes 22. The stator vanes 30 are arranged side by side in the circumferential direction Dc around the axis Ar. The stator vanes 30 are disposed at positions on an upstream side of the rotor vanes 22 of the rotor 2.

The partition plate 3 is vertically divided by the horizontal plane Sh. The partition plate 3 has an upper half partition plate (a half partition plate) 31 disposed above the axis Ar of the rotor 2, and a lower half partition plate (a half partition plate) 32 disposed below the axis Ar of the rotor 2.

The upper half partition plate 31 includes division surfaces 31X which are planes spreading in the horizontal direction, at both end portions in the circumferential direction Dc. Likewise, the lower half partition plate 32 includes division surfaces 32X which are planes spreading in the horizontal direction, at both end portions in the circumferential direction Dc.

Figure 3A:
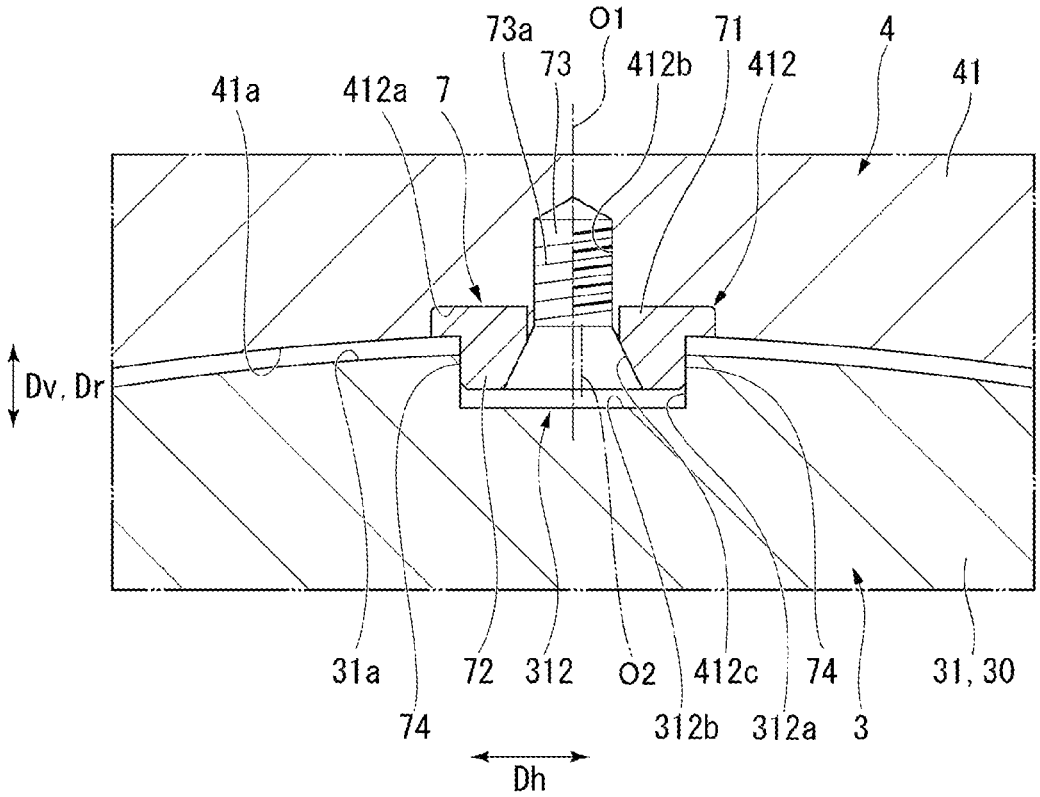
FIGS. 3A and 3B are enlarged view of a center guide pin disposed between an upper half casing and an upper half partition plate in FIG. 2.

FIG. 3A is an enlarged view of a center guide pin arranged between the upper half casing and the upper half partition plate in FIG. 2.

As illustrated in FIG. 3A, a groove portion 312 having a U-shaped cross section extending in the axial direction Da is formed on an outer peripheral surface 31*a* of the uppermost part (an upper side apex) of the upper half partition plate 31. The groove portion 312 includes two inner side surfaces 312*a* and a bottom surface 312*b*. The two inner side surfaces 312*a* spread in the vertical direction Dv and the axial direction Da, and face each other in the horizontal direction. The bottom surface 312*b* is formed on a plane extending in the horizontal direction that connects the inner side surfaces 312*a* inside in the radial direction Dr.

On an inner peripheral surface 41*a* of the upper half casing 41 facing the groove portion 312, a pin attachment portion 412 to which the center guide pin 7 can be attached is formed. The pin attachment portion 412 includes a concave portion 412*a* into which a pin base portion 71 (which will be described below) of the center guide pin 7 can be inserted, and a female screw portion 412*b* into which a male screw portion 73*a* of a fastening member 73 for fixing the center guide pin 7 to the upper half casing 41 is screwed.

Figure 3B:
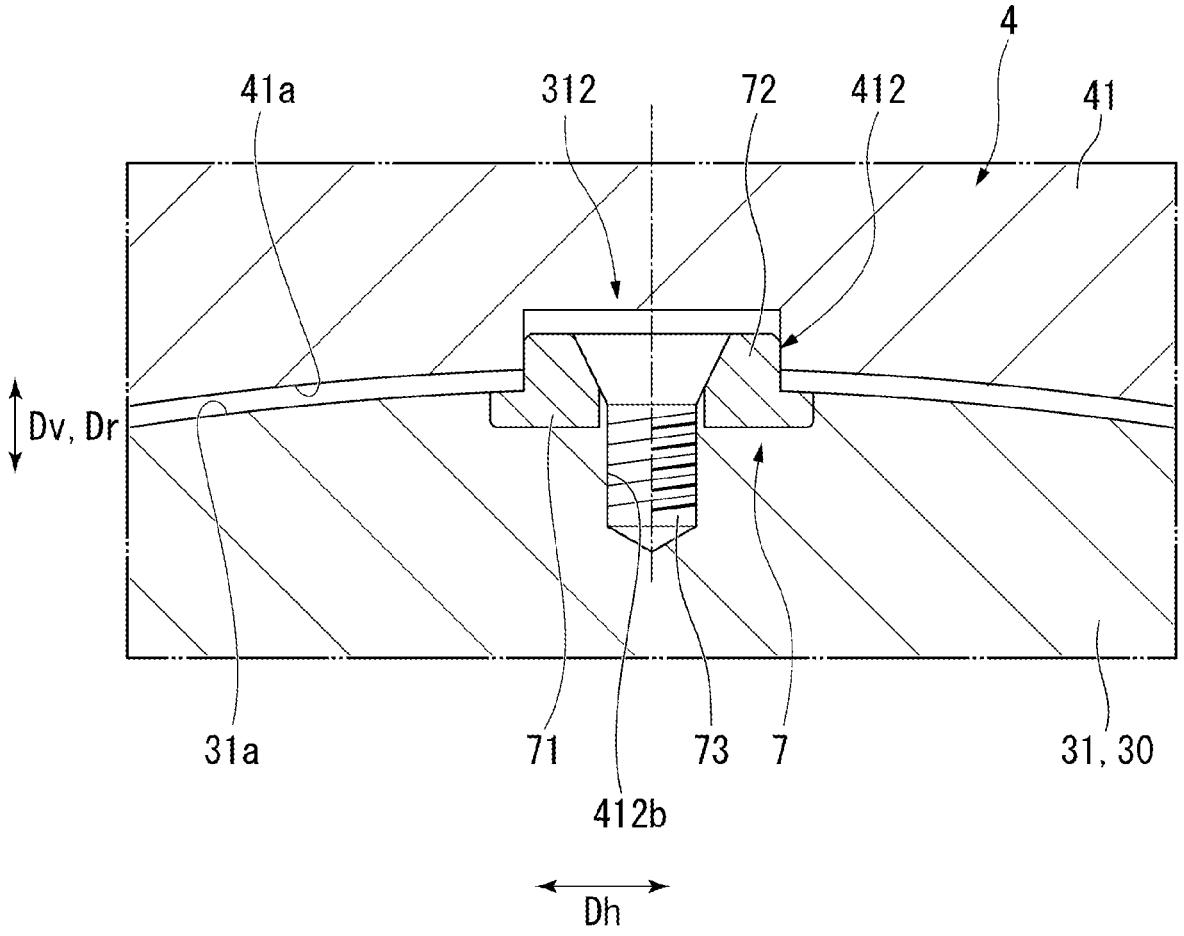

The groove portion 312 may be formed on the inner peripheral surface 41*a* of the upper half casing 41, as shown in FIG. 3B. In this construction, the pin attachment portion 412 is formed on the outer peripheral surface 31*a* of the uppermost part of the upper half partition plate 31.

As illustrated in FIG. 2, the vertical position defining portions 5 perform positioning of the upper half partition plate 31 in the vertical direction Dv with respect to the upper half casing 41. Each of the vertical position defining portions 5 is disposed near the division surface 41X of the upper half casing 41, and defines a relative position between both end portions of the upper half casing 41 in the circumferential direction Dc and both end portions of the upper half partition plate 31 in the circumferential direction Dc.

The vertical position defining portion 5 includes a regulating piece 51 and a bolt 52. An attachment concave portion 41*b* for attaching the vertical position defining portion 5 is formed in the upper half casing 41, and an insertion concave portion 31*b* into which the end portion of the regulating piece 51 is inserted is formed in the upper half partition plate 31. The regulating piece 51 can be fixed using a bolt 52 inside the attachment concave portion 41*b*. An end portion of the regulating piece 51 protrudes from the attachment concave portion 41*b* toward the upper half partition plate 31. The end portion of the regulating piece 51 is inserted into the insertion concave portion 31*b*. The insertion concave portion 31*b* restricts movement of the end portion of the inserted regulating piece 51 in the vertical direction Dv.

The center guide pin 7 performs positioning of the upper half partition plate 31 with respect to the upper half casing 41 in the horizontal direction Dh perpendicular to the axis Ah (hereinafter simply referred to as the horizontal direction Dh). The vertical position defining portion 5 is disposed between the uppermost portion of the upper half partition plate 31 and the upper half casing 41, and between the lowermost portion of the lower half partition plate 32 and the lower half casing 42, respectively. In other words, the center guide pins 7 are disposed on a vertical line Sv (see FIG. 2) passing through the axis Ah, respectively. Further, since the configuration of the center guide pin 7 disposed between the upper half casing 41 and the upper half partition plate 31 is the same as the configuration of the center guide pin 7 disposed between the lower half casing 42 and the lower half partition plate 32, only the center guide pin 7 disposed between the upper half casing 41 and the upper half partition plate 31 will be described.

Figure 4:
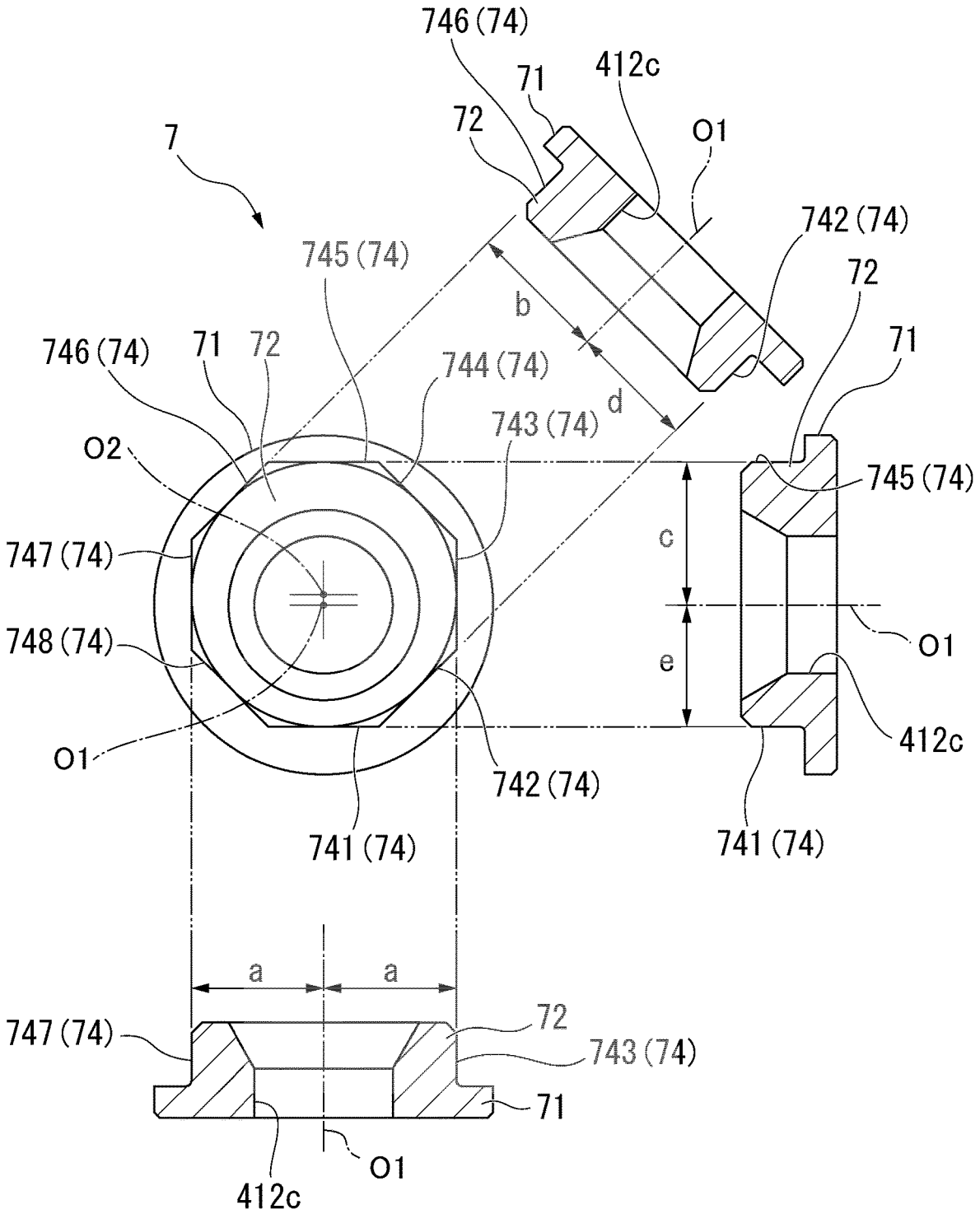
FIG. 4 is a diagram illustrating the center guide pin in the first embodiment of the present invention.

FIG. 4 is a diagram illustrating the center guide pin in the first embodiment of the present invention.

As illustrated in FIGS. 3A and 4, the center guide pin 7 includes a pin base portion 71 and a positioning portion 72.

The pin base portion 71 is accommodated in the concave portion 412*a* of the pin attachment portion 412. When attaching the pin base portion 71 to the pin attachment portion 412, it is possible to select a rotation angle about the pin axis O1. The pin base portion 71 in this first embodiment is formed in a disc shape centered on the pin axis O1, and the concave portion 412*a* of the pin attachment portion 412 forms a disc-shaped space slightly larger than the pin base portion 71.

Here, the aforementioned pin axis O1 is an axis extending from the axis Ar in the vertical direction Dv, and the pin axis O1 exemplified in the first embodiment overlaps the central axis of the hole 412*c* at which a screw (a fastening member) for attaching the center guide pin 7 to the upper half casing 41 penetrates the center guide pin 7.

The positioning portion 72 is disposed inside the groove portion 312 of the upper half casing 41. In the positioning portion 72 in the first embodiment, an outline of a cross section perpendicular to the pin axis O1 is formed in a tubular shape of a regular octagon. The central axis O2 of the regular octagon of the positioning portion 72 extends in parallel to the pin axis O1 and is offset in a direction perpendicular to the pin axis O1.

In the positioning portion 72, a distance between the parallel sides constituting the regular octagon is formed to be slightly smaller than the width of the above-described groove portion 312. Therefore, the positioning portion 72 can be disposed inside the groove portion 312. Two surfaces (abutment portions to be described later) constituting the parallel sides of the regular octagon simultaneously abut on the two inner side surfaces 312*a* of the groove portion 312, respectively. Therefore, the positioning portion 72 can move in the extending direction of the groove portion 312, and the movement of the groove portion 312 in the width direction is regulated.

The positioning portion 72 includes a plurality of abutment portions 74 that can abut on the inner side surface 312*a* of the groove portion 312, around the pin axis O1. The plurality of abutment portions 74 in the first embodiment are planes that form each side of the aforementioned regular octagon. In this embodiment, the plurality of abutment portions 74 include the eight abutment portions 74 of abutment portions 741, 742, 743, 744, 745, 746, 747, and 748.

Since the central axis O2 of the positioning portion 72 is offset from the pin axis O1, the plurality of abutment portions 74 are formed such that the distances from the pin axis O1 to the abutment portions 741, 742, 743, 744, and 745 (in other words, distances in the direction perpendicular to the pin axis O1) are different from each other. Similarly, the distances from the pin axis O1 to the abutment portions 741, 748, 747, 746, and 745 are also formed to be different from each other.

In the center guide pin 7 illustrated in the center of FIG. 4, the central axis O2 of the positioning portion 72 is offset from the pin axis O1 to the upper side of the paper surface of FIG. 4. By being formed in this way, in the two abutment portions 743 and 747 disposed on the left and right of FIG. 4 among the plurality of abutment portions 74, the distance from the pin axis is the same distance a. In the case in which one of the two abutment portions 743 and 747 is used as a reference surface, in the abutment portion 74 disposed in the direction in which the central axis O2 is offset with respect to the pin axis O1 (upper side in FIG. 4) in the circumferential direction of the positioning portion 72, the distance from the pin axis O1 increases (distance a<distance b<distance c). That is, the positioning portion 72 includes a plurality of abutment portions 74 having different distances from the pin axis O1. Since the distances between the parallel abutment portions 74 are all 'a+a=2a', a distance d from the pin axis O1 to the abutment portion 742 is smaller than the distance a (d=2a−b), and a distance e from the pin axis O1 to the abutment portion 741 is smaller than the distance a and smaller than the distance d (e=2a−c).

Here, in this embodiment, the abutment portions 74 disposed at line-symmetrical positions on the basis of a virtual straight line passing through the pin axis O1 and the central axis O2 have the same distance from the pin axis O1.

Next, a method for positioning the partition plate with respect to the casing in the horizontal direction using the center guide pin, which is part of the method for manufacturing the steam turbine, will be described.

Figure 5:
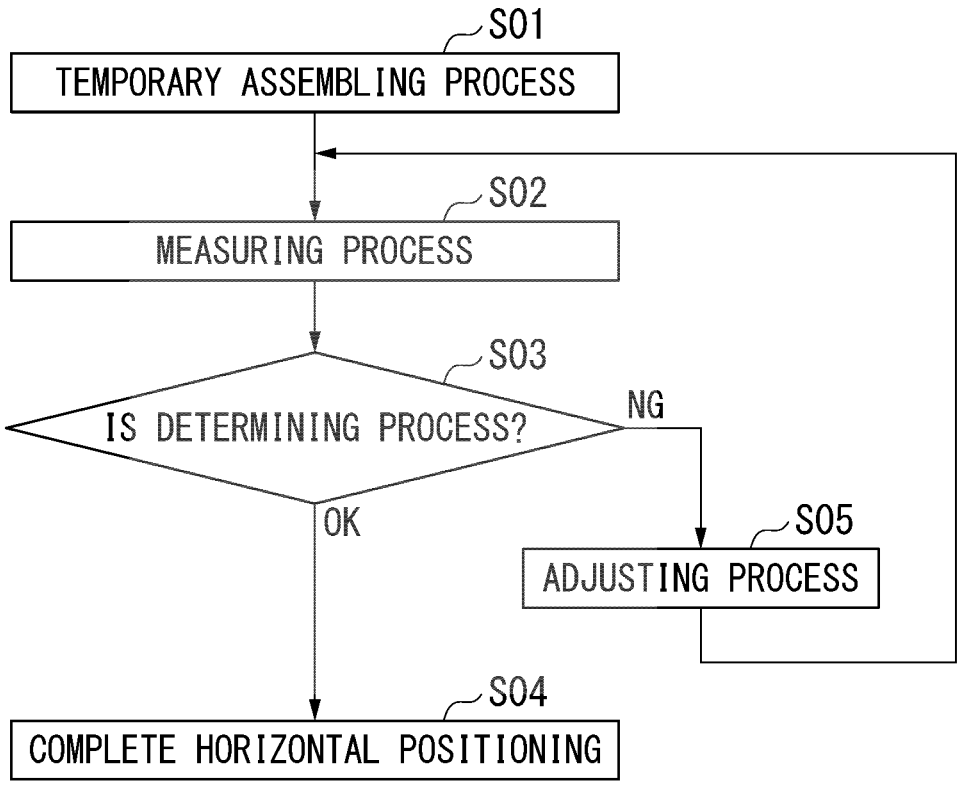
FIG. 5 is a flowchart of a method for manufacturing the steam turbine according to the first embodiment of the present invention.
Figure 6:
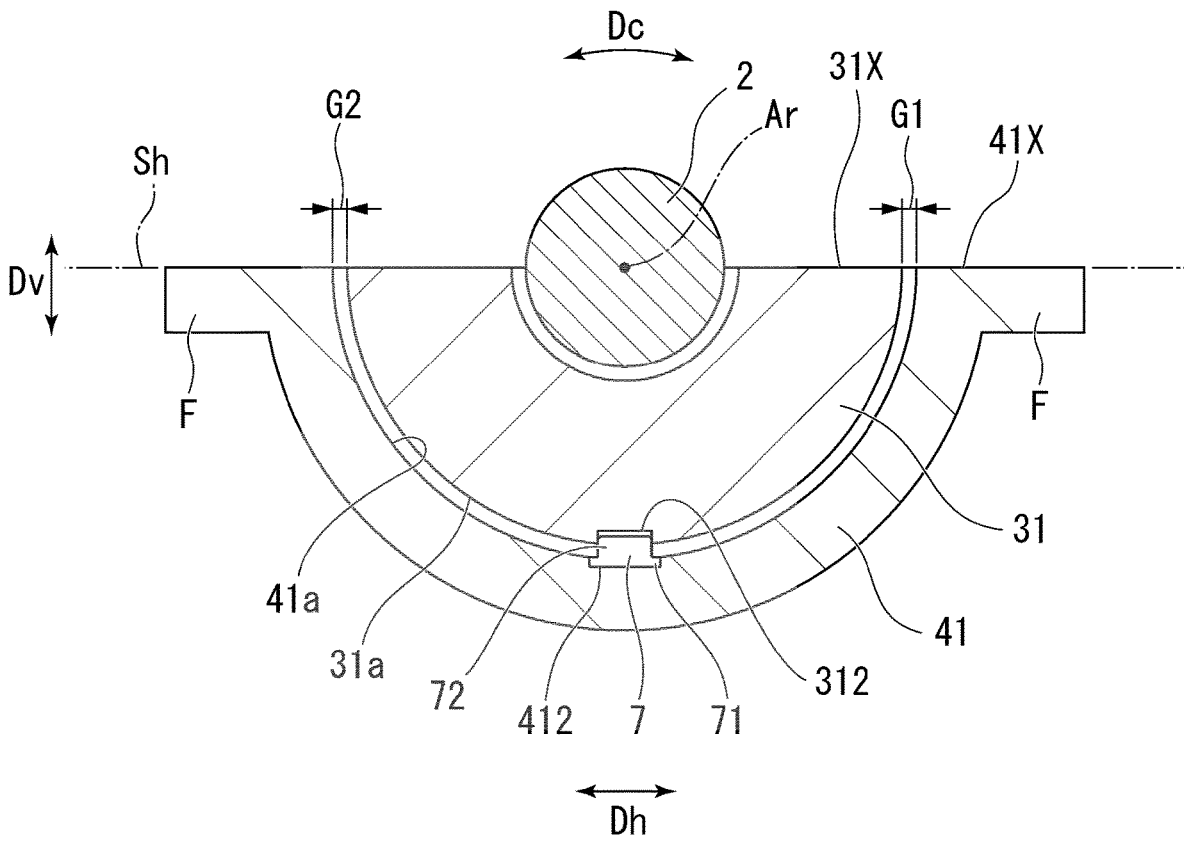
FIG. 6 is an explanatory view of the method for manufacturing the steam turbine according to the first embodiment of the present invention.

FIG. 5 is a flowchart of the method for manufacturing the steam turbine according to the first embodiment of the present invention. FIG. 6 is an explanatory view of the method for manufacturing the steam turbine according to the first embodiment of the present invention.

First, as illustrated in FIG. 5, a temporary assembling process (step S01) for temporarily assembling the upper half partition plate 31 with respect to the upper half casing 41 is performed. In this temporary assembling process, first, a horizontal state in which the division surface 41X of the upper half casing 41 faces upward is set. Next, the center guide pin 7 is attached to the pin attachment portion 412 formed in the upper half casing 41. Further, the upper half partition plate 31 is disposed inside the upper half casing 41 such that the positioning portion 72 of the center guide pin 7 is accommodated in the groove portion 312 of the upper half partition plate 31. As a result, any two of the eight abutment portions 74 of the center guide pin 7 abut on the inner side surface 312*a* of the groove portion 312, and positioning of the upper half partition plate 31 with respect to the upper half casing 41 in the horizontal direction Dh is performed.

Next, a measuring process (step S02) of measuring the gaps G1 and G2 between the upper half casing 41 and the upper half partition plate 31 is performed. In the measuring process, as illustrated in FIG. 6, the sizes of the gaps G1 and G2 between the upper half casing 41 and the upper half partition plate 31 are measured on the horizontal plane Sv. At this time, the sizes of the two gaps G1 and G2 are measured, respectively.

Thereafter, a determining process (step S03) of determining whether the sizes of the gap G1 and the gap G2 measured in the measuring process are within a preset target range is performed. In the determining process, it is determined whether both the aforementioned sizes of the gap G1 and the gap G2 are within a target range of a preset size.

In the determining process, when it is determined that the sizes of the gap G1 and the gap G2 are within the target range (OK), for example, by finally fastening the fastening member 73 (FIG. 3A) that fixes the center guide pin 7 to the upper half casing 41, positioning of the upper half partition plate 31 with respect to the upper half casing 41 in the horizontal direction is completed (step S04). In FIG. 6, the vertical position defining portion 5 is not illustrated. Detailed description of the positioning method in the vertical direction Dv performed by the vertical position defining portion 5 will be omitted.

In the determining process, if it is determined that each of the sizes of the two gaps G1 and G2 is not within the target range (NG), the process proceeds to an adjusting process (step S05).

In the adjusting process, the rotation angle of the center guide pin 7 is changed around the pin axis O1. For example, when the gap G1 is larger than the target range and the gap G2 is smaller than the target range, the rotation angle of the center guide pin 7 is changed so that the gap G1 decreases and the gap G2 increases. More specifically, among the plurality of abutment portions 74 formed in the positioning portion 72 of the center guide pin 7, the abutment portion 74 having a large distance from the pin axis O1 abuts on the inner side surface 312*a* of the groove portion 312 on the side closer to the gap G1. Further, in the adjusting process, after extracting the upper half partition plate 31 from the upper half casing 41 and changing the rotation angle of the center guide pin 7, the upper half partition plate 31 is disposed in the upper half casing 41 again.

After the adjusting process is performed, the process returns to the aforementioned measuring process. Further, the above-described determining process, adjusting process, and measuring process are repeated until each of the size of the gap G1 and the size of the gap G2 fall within the target range.

Positioning of the lower half partition plate 32 with respect to the lower half casing 42 in the horizontal direction Dh is also performed by the same process as the aforementioned positioning of the upper half casing 41 and the upper half partition plate 31. Therefore, a detailed description of the positioning of the lower half partition plate 32 with respect to the lower half casing 42 in the horizontal direction Dh will be omitted.

Further, a first assembly in which the upper half partition plate 31 is positioned with respect to the upper half casing 41 and a second assembly in which the lower half partition plate 32 is positioned with respect to the lower half casing 42 are assembled by placing the first assembly on the second assembly from above, in a state in which the rotor shaft 21 is disposed therein. That is, the steam turbine includes the first assembly and the second assembly.

Therefore, according to the above-described first embodiment, by changing the rotation angle of the center guide pin 7 attached to the pin attachment portion 412 around the pin axis O1, it is possible to change the abutment portion 74 caused to abut on the inner side surface 312*a* of the groove portion 312. Since the plurality of abutment portions 74 formed in the positioning portion 72 have different horizontal distances from the pin axis O1, the distance in the horizontal direction from the pin axis O1 to the inner side surface 312*a* of the groove portion 312 is changed. That is, it is possible to adjust the position of the partition plate 3 with respect to the casing 4 in the horizontal direction Dh perpendicular to the axis Ar, depending on the rotation angle of the center guide pin 7, without changing the type of the center guide pin 7.

As a result, the number of components can be reduced and the burden on the assembling worker can be reduced.

In addition, since the positioning portion 72 is formed in a regular octagonal tubular shape, a side portion of a regular octagon can be used as the abutment portion 74 of the positioning portion 72. Furthermore, since the central axis O2 of the regular octagon is offset with respect to the pin axis O1 in the horizontal direction Dh, it is possible to easily form a plurality of abutment portions 74 having different horizontal distances from the pin axis O1.

Although the case in which the side portion of the regular octagon is the abutment portion 74 has been described as an example, a corner portion formed between adjacent sides of the regular octagon may be used as the abutment portion 74. Further, although the case in which the cross section of the positioning portion 72 is a regular octagon has been described as an example, the cross section thereof may be a regular polygon such as an equilateral triangle, a regular tetragon, and a regular hexagon. Further, the cross-sectional shape of the positioning portion 72 may be a simple polygonal shape as long as the distance of the abutment portion 74 from the pin axis O1 is different at the plurality of abutment portions 74. However, in the case of a regular polygon having an even number of corner portions, since two sides formed to be parallel to the two inner side surfaces 312*a* of the groove portion 312 can be made to simultaneously abut, the positioning stability can be improved.

Second Embodiment

Next, a second embodiment of the present invention will be described with reference to the drawings. This second embodiment differs from the above-described first embodiment only in the shape of the positioning portion of the center guide pin. Therefore, the same parts as those of the above-described first embodiment are denoted by the same reference numerals, and redundant explanations thereof will be omitted.

Figure 7:
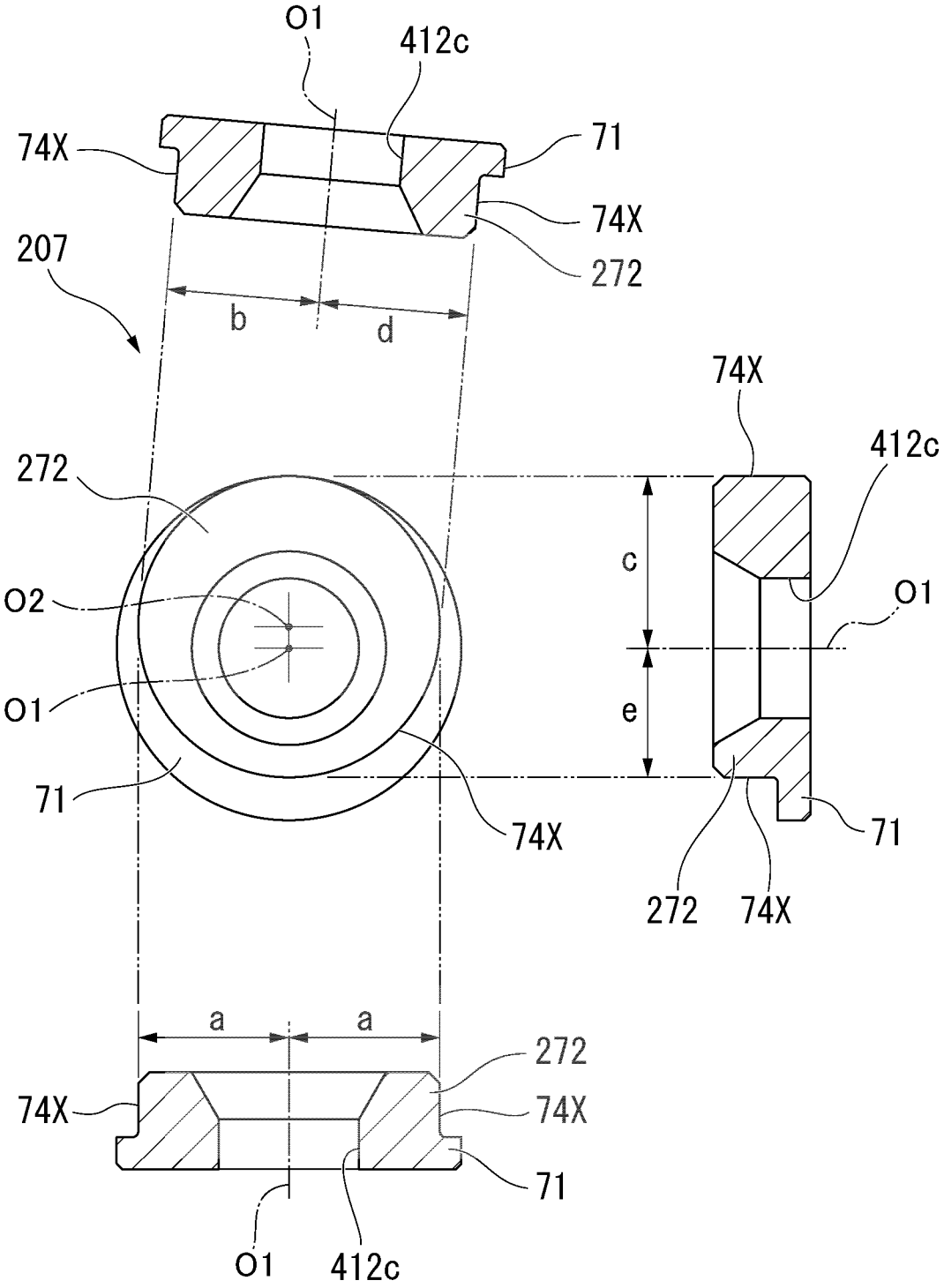
FIG. 7 is a view corresponding to FIG. 4 in a second embodiment of the present invention.

FIG. 7 is a view corresponding to FIG. 4 in the second embodiment of the present invention.

As illustrated in FIG. 7, the center guide pin 207 of the second embodiment includes a pin base portion 71 and a positioning portion 272, like the center guide pin 7 of the above-described first embodiment.

The positioning portion 272 is disposed inside the groove portion 312 of the upper half casing 41. An outline of the cross section of the positioning portion 272 of the second embodiment, which is perpendicular to the pin axis O1, is formed in a circular tubular shape, that is, a cylindrical shape. The central axis O2 of the positioning portion 272 extends in parallel to the pin axis O1 and is offset in a direction perpendicular to the pin axis O1. A diameter of the circular portion of the positioning portion 272 is formed to be slightly smaller than a width of the above-described groove portion 312. Therefore, the positioning portion 272 can be disposed inside the groove portion 312.

The positioning portion 272 includes a plurality of abutment portions 74X that can abut on the inner side surface 312*a* of the groove portion 312 around the pin axis O1. The abutment portion 74X in the second embodiment forms a curved surface forming the aforementioned cylinder. In other words, the abutment portion 74X is formed in a linear shape along the pin axis O1, and the linear abutment portions 74X are disposed in a circular shape around the central axis O2 of the positioning portion 272, thereby forming the curved surface.

Since the central axis O2 of the positioning portion 72 is offset from the pin axis O1, the plurality of abutment portions 74X have the different distances in the horizontal direction Dh from the pin axis O1 to each abutment portion 74X (in other words, the distances in the direction perpendicular to the pin axis O1).

Here, the two abutment portions 74X arranged to be point-symmetrical across the central axis O2 abut on the respective inner side surfaces 312*a* of the groove portions 312 at the same time. Therefore, the positioning portion 272 can move in the extending direction of the groove portion 312, and the movement of the groove portion 312 in the width direction is regulated.

Therefore, according to the above-described second embodiment, a circular outer peripheral portion can be used as the abutment portion 74X of the positioning portion 272. Therefore, it is possible to easily form a plurality of abutment portions 74X having different distances in the horizontal direction Dh from the pin axis O1. In addition, since the circular outer peripheral portion is used as the abutment portion 74X, the distance in the horizontal direction Dh from the pin axis O1 can be changed steplessly. Therefore, it is possible to more finely adjust the position of the partition plate 3 with respect to the casing 4 in the horizontal direction Dh perpendicular to the axis Ar.

The present invention is not limited to the configurations of the above-described embodiments, and the design can be changed within the scope that does not depart from the gist thereof.

For example, in each of the embodiments described above, the case in which the pin base portions 71 of the center guide pins 7 and 207 are formed in a disc shape has been described. However, the pin base portions 71 of the center guide pins 7 and 207 are not limited to a disc shape.

Furthermore, in each of the above-described embodiments, the case in which the pin attachment portion 412 is formed in the casing 4 and the groove portion 312 is formed on the partition plate 3 has been described. However, the pin attachment portion 412 may be formed in the partition plate 3, and the groove portion 312 may be formed on the casing 4.

Further, in each of the above-described embodiments, the countersunk screw-like fastening member 73 is exemplified as the fastening member 73, but the shape of the fastening member 73 is not limited to the countersunk screw shape. Further, the fastening member 73 may be a member capable of fastening the center guide pins 7 and 207 to the casing 4 or the partition plate 3 without using a screw action.

INDUSTRIAL APPLICABILITY

The present invention can be applied to a steam turbine, a center guide pin, and a method for manufacturing a steam turbine. According to the present invention, it is possible to reduce the number of components and to reduce the burden on the assembling worker.

REFERENCE SIGNS LIST

1 Steam turbine
2 Rotor
3 Partition plate
4 Casing
5 Vertical position defining portion
7, 207 Center guide pin
21 Rotor shaft
22 Rotor vane
30 Stator vane
31 Upper half partition plate
31*a* Outer side surface
31*b* Insertion concave portion
31X division surface
32 Lower half partition plate
32X division surface
41 Upper half casing
41*a* Inner peripheral surface

41*b* Attachment concave portion
41X Division surface
42 Lower half casing
42X Division surface
51 regulating piece
52 bolt
71 Pin base portion
72, 272 Positioning portion
73 Fastening member
73*a* male screw portion
74 Abutment portion
741 to 748 Abutment portion
74X Abutment portion
312 Groove portion
312*a* Inner side surface
312*b* Bottom surface
412 Pin attachment portion
412*a* Concave portion
412*b* Female screw portion
412*c* hole
742 abutment portion
743 abutment portion
744 abutment portion
745 abutment portion
746 abutment portion
747 abutment portion
F Flange portion
Da Axial direction
Dr Radial direction
Dv Vertical direction
Dh Horizontal direction
Dc Circumferential direction
Sh Horizontal plane
Sv Vertical surface
Ar axis
O1 pin axis
O2 central axis
a distance
b distance
c distance
b distance
e distance
S01 step
S02 step
S03 step
S04 step
S05 step

The invention claimed is:

1. A steam turbine comprising:

a rotor rotatable around an axis, a casing that extends in a circumferential direction of the rotor and is vertically divided in a horizontal plane, a partition plate that is disposed between the casing and the rotor, extends in the circumferential direction of the rotor, and is vertically divided by the horizontal plane; and center guide pins that:

position the partition plate with respect to the casing in a horizontal direction from above or below the horizontal plane, and each include a penetration hole at which a screw having a male screw portion is configured to penetrate a corresponding one of the center guide pins, wherein either one of the following is satisfied:

an outer surface of the partition plate includes groove portions disposed respectively at a vertically upward position and a vertically downward position with respect to the axis and extending in a direction of the axis, an inner surface of the casing facing the outer surface of the partition plate includes pin attachment portions disposed respectively at a vertically upward position and a vertically downward position with respect to the axis, the male screw portion is inserted to the casing, and each of the center guide pins is fixed in all directions to the casing by the male screw portion such that a rotation angle of the each of the center guide pins is fixed with respect to the casing, or the inner surface of the casing includes groove portions disposed respectively at the vertically upward position and the vertically downward position with respect to the axis and extending in the direction of the axis, the outer surface of the partition plate facing the inner surface of the casing includes pin attachment portions disposed respectively at the vertically upward position and the vertically downward position with respect to the axis, the male screw portion is inserted into the partition plate, and each of the center guide pins is fixed in all directions to the partition plate by the male screw portion such that a rotation angle of the each of the center guide pins is fixed with respect to the partition plate, a rotation angle around a pin axis is changed by rotating the center guide pins and the pin attachment portions respectively, each of the center guide pins includes a positioning portion disposed inside each of the groove portions in a state of being attached to each of the pin attachment portions, the positioning portion includes abutment portions each configured to abut against an inner side surface of each of the groove portions, the pin attachment portions being disposed around the pin axis, the abutment portions are formed so that distances in the horizontal direction from the pin axis are different respectively each of the center guide pins includes a pin base portion that is formed in a circular disc shape centered on the pin axis, and each of the pin attachment portions includes:

a concave portion that accommodates the pin base portion to be rotatable about the pin axis, and a female screw portion that is formed on an extension line of the pin axis and configured to accept the male screw portion of the screw.

2. The steam turbine according to claim 1, wherein the positioning portion is in a tubular shape in which an outline of a cross section perpendicular to the pin axis is in a shape of a regular polygon, and a central axis of the regular polygon is offset with respect to the pin axis in the horizontal direction.

3. The steam turbine according to claim 1, wherein the positioning portion is in a tubular shape in which an outline of a cross section perpendicular to the pin axis is in a shape of a circle, and a central axis of the tubular shape is offset with respect to the pin axis in the horizontal direction.

4. A center guide pin configured to position a partition plate with respect to a casing of a steam turbine in a horizontal direction perpendicular to a rotor shaft, the center guide pin comprising:

a positioning portion configured to be accommodated in a groove portion; and a pin base portion attachable to a pin attachment portion and that includes a penetration hole at which a screw having a male screw portion is configured to penetrate the center guide pin, wherein either one of the following is satisfied:

the groove portion is disposed on an outer surface of the partition plate, the pin attachment portion is disposed on an inner surface of the casing, the male screw portion is inserted into the casing, and the center guide pin is fixed in all directions to the casing by the male screw portion such that a rotation angle of the center guide pin is fixed with respect to the casing, or the groove portion is disposed on the inner surface of the casing, the pin attachment portion is disposed on the outer surface of the partition plate, the male screw portion is inserted into the partition plate, and the center guide pin is fixed in all directions to the partition plate by the male screw portion such that a rotation angle of the center guide pin is fixed with respect to the partition plate, a rotation angle around a pin axis is changed by rotating the center guide pin, the pin base portion is fixable to the pin attachment portion, the positioning portion includes abutment portions each configured to abut against an inner side surface of the groove portion, the abutment portions are formed so that distances from the pin axis in the horizontal direction are different respectively, the pin base portion is formed in a circular disc shape centered on the pin axis.

5. The center guide pin according to claim 4, wherein the positioning portion is in a tubular shape in which an outline of a cross section perpendicular to the pin axis is in a shape of a regular polygon, and a central axis of the regular polygon is offset with respect to the pin axis in the horizontal direction.

6. The center guide pin according to claim 4, wherein the positioning portion is in a tubular shape in which an outline of a cross section perpendicular to the pin axis is in a shape of a circle, and a central axis of the tubular shape is offset with respect to the pin axis in the horizontal direction.

* * * * *